US010247440B2

(12) United States Patent
Tanaka

(10) Patent No.: US 10,247,440 B2
(45) Date of Patent: Apr. 2, 2019

(54) AIR-CONDITIONING APPARATUS WITH CONTROL OF EXPANSION VALVE TO MAINTAIN DESIRED DEGREE OF SUBCOOLING

(71) Applicant: Mitsubishi Electric Corporation, Tokyo (JP)

(72) Inventor: Kosuke Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/508,979

(22) PCT Filed: Nov. 19, 2014

(86) PCT No.: PCT/JP2014/080696
§ 371 (c)(1),
(2) Date: Mar. 6, 2017

(87) PCT Pub. No.: WO2016/079834
PCT Pub. Date: May 26, 2016

(65) Prior Publication Data
US 2017/0276391 A1 Sep. 28, 2017

(51) Int. Cl.
*F24F 11/02* (2006.01)
*F24F 11/89* (2018.01)
(Continued)

(52) U.S. Cl.
CPC ..... *F24F 11/89* (2018.01); *F24F 11/72* (2018.01); *F25B 1/00* (2013.01); *F25B 13/00* (2013.01);
(Continued)

(58) Field of Classification Search
CPC ..... F25B 2400/05; F25B 2600/2513; F25B 2700/1931; F25B 2700/21152
See application file for complete search history.

(56) References Cited

U.S. PATENT DOCUMENTS 6,289,691 B1 * 9/2001 Kim ..... F25B 5/04 62/513
6,880,353 B1 * 4/2005 Yap ..... F25B 9/008 62/277
(Continued)

FOREIGN PATENT DOCUMENTS

CN 102792108 A 11/2012
JP 61-153356 A 7/1986
(Continued)

OTHER PUBLICATIONS

International Search Report of the International Searching Authority dated Feb. 24, 2015 for the corresponding international application No. PCT/JP2014/080696 (and English translation).
(Continued)

*Primary Examiner* — Jonathan Bradford
(74) *Attorney, Agent, or Firm* — Posz Law Group, PLC

(57) ABSTRACT

An air-conditioning apparatus includes an internal heat exchanger in which refrigerant flowing through a refrigerant pipe between an outdoor heat exchanger and an expansion device and refrigerant flowing through a refrigerant pipe between the expansion device and an indoor heat exchanger exchange heat, a pressure sensor, a first temperature sensor that detects temperature of the refrigerant flowing into the expansion device in the cooling operation, and a control unit configured to control the opening degree of the expansion device based on results of detection by the pressure sensor and the first temperature sensor in the cooling operation.

5 Claims, 2 Drawing Sheets

(51) Int. Cl.

| | |
|---|---|
| ***F25B 1/00*** | (2006.01) |
| ***F25B 13/00*** | (2006.01) |
| ***F25B 49/02*** | (2006.01) |
| ***F24F 11/72*** | (2018.01) |

(52) U.S. Cl.

CPC ..... *F25B 49/02* (2013.01); *F25B 2400/05* (2013.01); *F25B 2600/2513* (2013.01); *F25B 2700/1931* (2013.01); *F25B 2700/2103* (2013.01)

(56) References Cited

U.S. PATENT DOCUMENTS

| | | | | |
|---|---|---|---|---|
| 2009/0272135 | A1 | 11/2009 | Nishimura et al. | |
| 2011/0174059 | A1* | 7/2011 | Yonemori ..... | F25B 49/005 73/40 |
| 2012/0318011 | A1* | 12/2012 | Ochiai ..... | F25B 49/005 62/127 |
| 2013/0019613 | A1 | 1/2013 | Lee et al. | |
| 2015/0034293 | A1 | 2/2015 | Takayama et al. | |

FOREIGN PATENT DOCUMENTS

| | | | |
|---|---|---|---|
| JP | 02-075863 | A | 3/1990 |
| JP | 04-254167 | A | 9/1992 |
| JP | 06-331223 | A | 11/1994 |
| JP | 2012-127606 | A | 7/2012 |
| WO | 2013/144994 | A1 | 10/2013 |

OTHER PUBLICATIONS

Office Action dated Nov. 10, 2015 issued in the corresponding Japanese patent application No. 2015-538182 (and English translation).

Office Action dated Jan. 5, 2018 issued in corresponding AU patent application No. 2014411657.

Extended European Search Report corresponding to European Patent Application No. 14906356.2 dated May 23, 2018.

Office Action dated Apr. 29, 2018 issued in corresponding KR patent application No. 10-2017-7014344 (and English translation).

Office Action dated Nov. 27, 2018 issued in corresponding CN patent application No. 201480082619.X (and English translation).

* cited by examiner

AIR-CONDITIONING APPARATUS WITH CONTROL OF EXPANSION VALVE TO MAINTAIN DESIRED DEGREE OF SUBCOOLING

CROSS REFERENCE TO RELATED APPLICATION

This application is a U.S. national stage application of International Application No. PCT/JP2014/080696, filed on Nov. 19, 2014, the contents of which are incorporated herein by reference.

TECHNICAL FIELD

The present invention relates to an air-conditioning apparatus, and in particular, to an air-conditioning apparatus capable of performing at least cooling operation.

BACKGROUND

Various types of air-conditioning apparatuses, allowing a use-side heat exchanger such as an indoor heat exchanger to function as an evaporator and capable of performing at least cooling operation, have been proposed conventionally. As such a conventional air-conditioning apparatus, a multiple-chamber air-conditioning apparatus including a plurality of indoor heat exchangers connected in parallel is also proposed (see Patent Literature 1), for example. The multiple-chamber air-conditioning apparatus has an expansion valve corresponding to each of the indoor heat exchangers. In more detail, a refrigerant pipe, connecting an outdoor heat exchanger and indoor heat exchangers, is configured such that the indoor heat exchanger side thereof is branched into a plurality of branch pipes, and that the indoor heat exchangers are connected to the respective branch pipes whereby the indoor heat exchangers are connected in parallel. Further, an expansion valve is provided to each of the branch pipes, corresponding to one of the indoor heat exchangers.

In a conventional multiple-chamber air-conditioning apparatus configured as describe above, an air conditioning load placed on each indoor heat exchanger differs. This means that in a conventional multiple-chamber air-conditioning apparatus, the flow amount of refrigerant flowing inside must be different for each indoor heat exchanger. As such, in the conventional multiple-chamber air-conditioning apparatus, in the cooling operation when an indoor heat exchanger serves as an evaporator, the opening degree of each expansion valve provided corresponding to one of the indoor heat exchangers is controlled such that a degree of superheat of the refrigerant flowing through each indoor heat exchanger falls within a prescribed range.

PATENT LITERATURE

Patent Literature 1: Japanese Unexamined Patent Application Publication No. 61-153356 (Claims, FIG. 1)

As described above, in a conventional multiple-chamber air-conditioning apparatus, the flow amount of the refrigerant flowing through each indoor heat exchanger is adjusted using a degree of superheat, in the cooling operation. As such, in the cooling operation, in the conventional multiple-chamber air-conditioning apparatus, the refrigerant flowing near the outlet of each indoor heat exchanger becomes gas refrigerant (superheated gas) having a lower heat transfer coefficient, compared with the refrigerant in a gas-liquid two-phase state. Accordingly, in the conventional multiple-chamber air-conditioning apparatus, there is a problem that heat transfer performance of each indoor heat exchanger deteriorates in the cooling operation.

SUMMARY

The present invention is made to overcome the above-described problem. An object of the present invention is to obtain an air-conditioning apparatus capable of improving heat transfer performance of an indoor heat exchanger in the cooling operation compared with the conventional one.

An air-conditioning apparatus according to an embodiment of the present invention includes a refrigeration cycle circuit in which a compressor, a first heat exchanger, an expansion device, and a second heat exchanger are connected sequentially to circulate a refrigerant therethrough; a third heat exchanger configured to cause the refrigerant flowing through a refrigerant pipe between the first heat exchanger and the expansion device to exchange heat with the refrigerant flowing through a refrigerant pipe between the expansion device and the second heat exchanger; a detector configured to detect at least one of a temperature and a pressure of the refrigerant flowing through one of the first heat exchanger and the second heat exchanger serving as a condenser; a first temperature sensor configured to detect a temperature of the refrigerant flowing into the expansion device; and a control unit configured to control an opening degree of the expansion device based on the results of detection by the detector and the first temperature sensor.

An air-conditioning apparatus according to an embodiment of the present invention includes a third heat exchanger in which the refrigerant flowing through a refrigerant pipe between the first heat exchanger and the expansion device and the refrigerant flowing through a refrigerant pipe between the expansion device and the second heat exchanger exchange heat. Accordingly, in the case where a plurality of second heat exchangers as use-side heat exchangers are provided, the air-conditioning apparatus according to an embodiment of the present invention is able to allow refrigerant of the amount appropriate to the cooling load to flow for each second heat exchanger by controlling the opening degree of the expansion device, based on the results of detection by the detector and the first temperature sensor in the cooling operation. This means that in the air-conditioning apparatus according to an embodiment of the present invention, even in the case where a plurality of second heat exchangers as use-side heat exchanger are provided, there is no need to cause the refrigerant flowing near the outlet of each indoor heat exchanger to become gas refrigerant in the cooling operation. Accordingly, the air-conditioning apparatus according to an embodiment of the present invention is able to improve the heat transfer performance of each indoor heat exchanger compared with the conventional one in the cooling operation.

It should be noted that the air-conditioning apparatus according to an embodiment of the present invention is not limited to one having a plurality of second heat exchangers. The air-conditioning apparatus may include one second heat exchanger, of course. By controlling the opening degree of the expansion device based on the results of detection by the detector and the first temperature sensor in the cooling operation, there is no need to cause the refrigerant flowing near the outlet of the indoor heat exchanger to become gas refrigerant, whereby it is possible to improve the heat transfer performance of the indoor heat exchanger compared with the conventional one.

DETAILED DESCRIPTION

Embodiment

Figure 1:
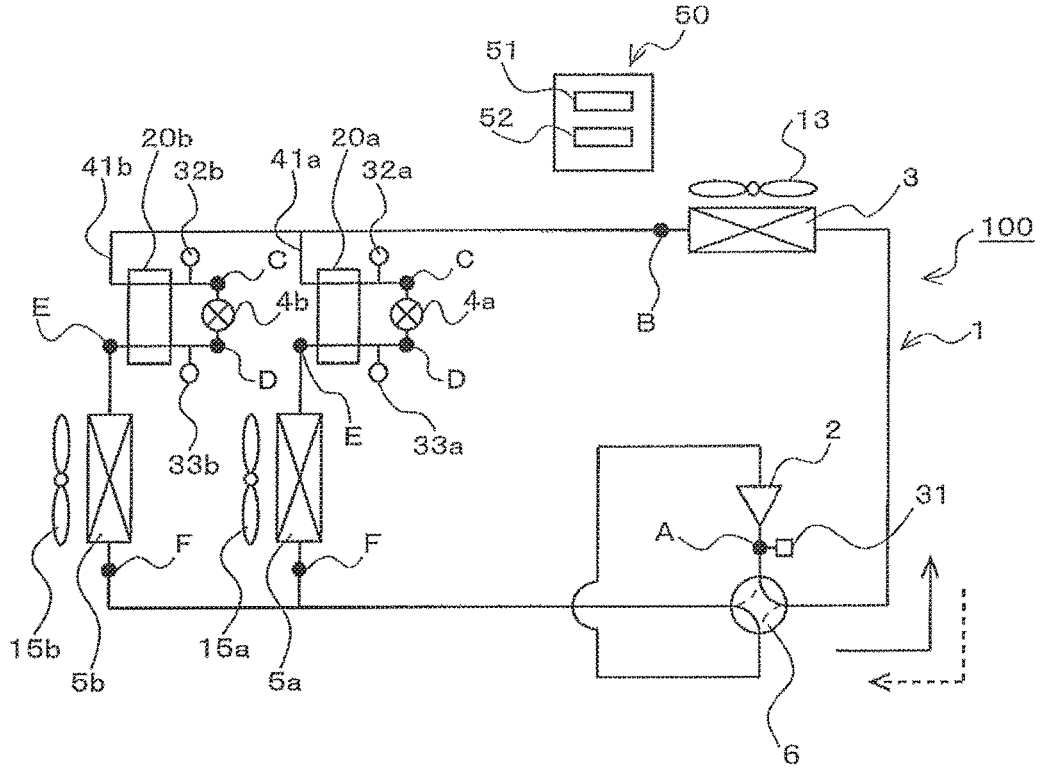
FIG. 1 is a configuration diagram illustrating an example of an air-conditioning apparatus according to an embodiment of the present invention.

FIG. 1 is a configuration diagram illustrating an example of an air-conditioning apparatus according to an embodiment of the present invention.

An air-conditioning apparatus 100 according to the present embodiment includes a refrigeration cycle 1 in which a compressor 2, an outdoor heat exchanger 3 that is a heat-source side heat exchanger, a plurality of expansion devices 4, and a plurality of indoor heat exchangers 5 that are use-side heat exchangers are connected sequentially via refrigerant pipes. This means that the air-conditioning apparatus 100 includes the refrigeration cycle 1 capable of performing cooling operation in which the indoor heat exchanger 5 serves as an evaporator and the outdoor heat exchanger 3 serves as a condenser.

In this example, the outdoor heat exchanger 3 corresponds to a first heat exchanger of the present invention. Further, the indoor heat exchanger 5 corresponds to a second heat exchanger of the present invention.

The compressor 2 sucks refrigerant and compresses the refrigerant to make it in a high-temperature and high-pressure state. The type of the compressor 2 is not limited particularly. For example, the compressor 2 can be configured using any of various types of compressing mechanisms such as a reciprocating type, a rotary type, a scrolling type, and a screw type. Preferably, the compressor 2 is configured by using one having the type that the rotation speed is controllable in a variable manner by the inverter. The discharge portion of the compressor 2 is connected with the outdoor heat exchanger 3.

The outdoor heat exchanger 3 is an air-cooled type heat exchanger that allows the refrigerant flowing inside and the outdoor air to exchange heat. In the case of using the outdoor heat exchanger 3 of an air-cooled type heat exchanger as the first heat exchanger, it is better to provide an outdoor fan 13 for supplying outside air, that is, a target of heat exchange, to the outdoor heat exchanger 3, near the outdoor heat exchanger 3. The outdoor heat exchanger 3 is connected with a plurality of indoor heat exchangers 5 via a plurality of expansion devices 4. It should be noted that the first heat exchanger is not limited to the outdoor heat exchanger 3 of an air-cooled type heat exchanger. The type of the first heat exchanger may be selected appropriately according to the target with which the refrigerant exchanges heat. When heat is exchanged with water or brine, the first heat exchanger may be a water heat exchanger.

The indoor heat exchanger 5 is an air-cooled type heat exchanger that allows the refrigerant flowing inside and indoor air to exchange heat. In the case of using the indoor heat exchanger 5 of an air-cooled type heat exchanger as the second heat exchanger, it is better to provide an indoor fan 15 for supplying indoor air, that is, a heat exchange target, to the indoor heat exchanger 5, near the indoor heat exchanger 5. The indoor heat exchanger 5 is connected with a suction port of the compressor 2. It should be noted that the second heat exchanger is not limited to the indoor heat exchanger 5 of an air-cooled type heat exchanger. The type of the second heat exchanger may be selected appropriately according to the target with which the refrigerant exchanges heat. When heat is exchanged with water or brine, the second heat exchanger may be a water heat exchanger. This means that it is possible to supply water or brain, with which the refrigerant having exchanged heat in the second heat exchanger, into the room and perform cooling or the like using the water or the brain supplied inside the room.

As described above, the air-conditioning apparatus 100 of the present embodiment includes a plurality of indoor heat exchangers 5. FIG. 1 illustrates an example in which two indoor heat exchangers 5*a* and 5*b* are provided, and indoor fans 15*a* and 15*b* are provided near the indoor heat exchangers 5*a* and 5*b*. In detail, a refrigerant pipe connecting the outdoor heat exchanger 3 and the indoor heat exchanger 5 is configured such that the indoor heat exchanger 5 side thereof is branched into a plurality of branch pipes 41 (as many as the indoor heat exchangers 5). In FIG. 1, it is branched into two branch pipes 41*a* and 41*b* corresponding to the indoor heat exchangers 5*a* and 5*b*. Then, the indoor heat exchangers 5 are connected with the branch pipes 41 respectively, whereby the respective indoor heat exchangers 5 are connected in parallel.

The expansion device 4 is an expansion valve, for example, which decompresses and expands the refrigerant. The expansion device 4 is provided corresponding to each of the indoor heat exchangers 5. This means that the air-conditioning apparatus 100 includes as many expansion devices 4 as the indoor heat exchangers 5. In detail, the expansion device 4 is provided to each of the branch pipes 41 corresponding to each of the indoor heat exchangers 5. In the case of FIG. 1, an expansion device 4*a* is provided to the branch pipe 41*a*, and an expansion device 4*b* is provided to the branch pipe 41*b*.

Further, in the air-conditioning apparatus 100 of the present embodiment, a flow switching device 6, that is, a four-way valve, for example, is provided to the refrigeration cycle 1, to enable the indoor heat exchanger 5 to serve as a condenser and enable the outdoor heat exchanger 3 to function as an evaporator so as to achieve heating operation. The flow switching device 6 is configured to switch to connect the discharge port of the compressor 2 to one of the outdoor heat exchanger 3 and the indoor heat exchanger 5, and connect the suction port of the compressor 2 to the other of the outdoor heat exchanger 3 and the indoor heat exchanger 5. By connecting the discharge port of the compressor 2 to the indoor heat exchanger 5, and connecting the suction port of the compressor 2 to the outdoor heat exchanger 3, the refrigeration cycle 1 is configured such that the compressor 2, the indoor heat exchanger 5, the expansion device 4, and the outdoor heat exchanger 3 are connected sequentially via refrigerant pipes. Thereby, the air-conditioning apparatus 100 is able to perform not only cooling operation but also heating operation.

Further, the air-conditioning apparatus 100 of the present embodiment includes an internal heat exchanger 20 that allows the refrigerant flowing through a refrigerant pipe between the outdoor heat exchanger 3 and the expansion device 4 and the refrigerant flowing through a refrigerant pipe between the expansion device 4 and the indoor heat exchanger 5 to exchange heat. Similar to the expansion device 4, the internal heat exchanger 20 is provided corresponding to each of the indoor heat exchangers 5 as the expansion device 4. This means that the air-conditioning apparatus 100 includes the internal heat exchangers 20 as many as the indoor heat exchangers 5. In detail, the internal heat exchanger 20 is provided to each of the branch pipes 41 corresponding to each of the indoor heat exchangers 5. In the case of FIG. 1, the internal heat exchanger 20*a* is provided to the branch pipe 41*a*, and the internal heat exchanger 20*b* is provided to the branch pipe 41*b*.

In this example, the internal heat exchanger 20 corresponds to a third heat exchanger of the present invention.

The air-conditioning apparatus 100 configured as described above also includes a controller 50 that controls opening degrees of the expansion devices 4*a* and 4*b*, and various types of detectors for detecting refrigerant temperature used for controlling opening degrees of the expansion devices 4*a* and 4*b* by the controller 50.

In detail, a pressure sensor 31 that detects pressure of refrigerant discharged from the compressor 2 (high-pressure side pressure from the discharge port of the compressor 2 to the expansion device 4) is provided on a pipe of the discharge side of the compressor 2. A portion of the refrigerant pipe located between the internal heat exchanger 20 and the expansion device 4, of the refrigerant pipe between the outdoor heat exchanger 3 and the expansion device 4, is provided with a first temperature sensor 32 that detects temperature of the refrigerant flowing into the expansion device 4 in the cooling operation. Further, a portion of the refrigerant pipe located between the expansion device 4 and the internal heat exchanger 20, of the refrigerant pipe between the expansion device 4 and indoor heat exchanger 5, is provided with a second temperature sensor 33 that detects temperature of the refrigerant flowing into the expansion device 4 in the heating operation.

Similar to the expansion device 4 and the internal heat exchanger 20, the first temperature sensor 32 and the second temperature sensor 33 are provided to each of the indoor heat exchangers 5. This means that the air-conditioning apparatus 100 includes the first temperature sensors 32 and the second temperature sensors 33 as many as the indoor heat exchangers 5. In detail, the first temperature sensor 32 and the second temperature sensor 33 are provided to each of the branch pipes 41 corresponding to each of the indoor heat exchangers 5. In the case of FIG. 1, a first temperature sensor 32*a* and a second temperature sensor 33*a* are provided to the branch pipe 41*a*, and a first temperature sensor 32*b* and a second temperature sensor 33*b* are provided to the branch pipe 41*b*.

The controller 50 includes a control unit 51 and an arithmetic unit 52.

The arithmetic unit 52 is configured to convert a pressure value detected by the pressure sensor 31 into condensing temperature of the refrigerant flowing through the condenser. The arithmetic unit 52 also computes a difference between the condensing temperature and the temperature detected by the first temperature sensor 32 (degree of subcooling) in the cooling operation. The arithmetic unit 52 also computes a difference between the condensing temperature and the temperature detected by the second temperature sensor 33 (degree of subcooling) in the heating operation.

In this example, the pressure sensor 31 corresponds to a detector of the present invention.

The control unit 51 is configured to control the opening degree of each of the expansion devices 4 based on the results of detection by the pressure sensor 31 and the first temperature sensor 32 in the cooling operation, and control the opening degree of each of the expansion devices 4 based on the results of detection by the pressure sensor 31 and the second temperature sensor 33 in the heating operation. In detail, the control unit 51 controls the opening degree of each of the expansion devices 4 such that the degree of subcooling falls within a prescribed temperature range (control target range), at the time of both cooling operation and heating operation. For example, in the cooling operation, the control unit 51 controls the opening degree of the expansion device 4*a* such that a difference between the condensing temperature and the temperature detected by the first temperature sensor 32*a* falls within a prescribed temperature range, and controls the opening degree of the expansion device 4*b* such that a difference between the condensing temperature and the temperature detected by the first temperature sensor 32*b* falls within a predetermined temperature range. Further, in the present embodiment, the control unit 51 is also configured to control the rotation speed of the compressor 2, the outdoor fan 13, and the indoor fan 15.

It should be noted that in the case where the air-conditioning apparatus 100 does not perform heating operation, the second temperature sensor 33 is unnecessary.

In the air-conditioning apparatus 100 configured as described above, as refrigerant circulating the refrigeration cycle 1, refrigerant containing at least one of R32 (difluoromethane), HFO1234yf (2, 3, 3, 3-tetrafluoropropene), HFO1234ze (1, 3, 3, 3-tetrafluoropropene), HFO1123 (1, 1, 2-trifluoroethylene), and hydrocarbon, for example, is used.

Next, operation of the air-conditioning apparatus 100 of the present embodiment will be described.

Figure 2:
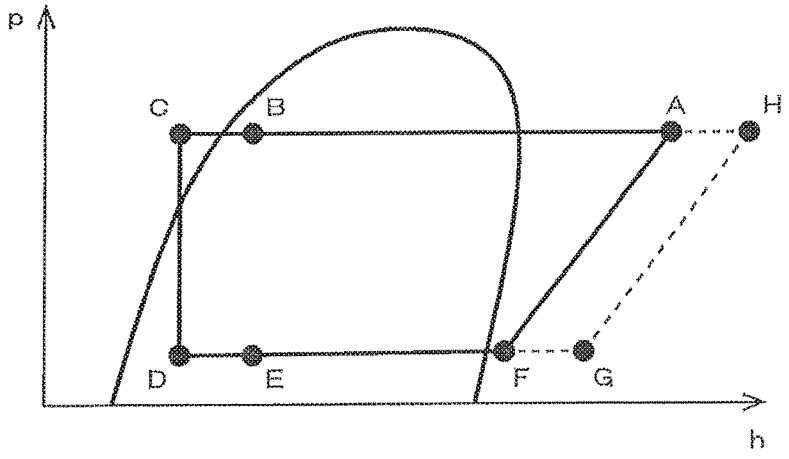
FIG. 2 is a p-h diagram (relationship diagram between refrigerant pressure p and specific enthalpy h) for explaining an operating state of an air-conditioning apparatus according to an embodiment of the present invention.

FIG. 2 is a p-h diagram (relationship diagram between refrigerant pressure p and specific enthalpy h) for explaining an operating state of the air-conditioning apparatus according to the embodiment of the present invention. Points A to F in FIG. 2 show states of refrigerant at points A to F in FIG. 1. Further, the broken lines illustrated in FIG. 2 show refrigerant state in a conventional multiple-chamber air-conditioning apparatus in which the amount of refrigerant flowing through each indoor heat exchanger is controlled by controlling a degree of superheat in the cooling operation. Hereinafter, operation of the air-conditioning apparatus 100 according to the present embodiment will be described with use of FIGS. 1 and 2.

[Cooling Operation]

(At Activation)

In the cooling operation, the flow channel in the flow switching device 6 is a flow channel shown by a solid line in FIG. 1. As such, when the compressor 2 activates, the refrigerant in the refrigeration cycle 1 flows in a direction shown by a solid arrow in FIG. 1. In detail, when the compressor 2 activates, refrigerant is sucked from the suction port of the compressor 2. Then, the refrigerant becomes high-temperature and high-pressure gas refrigerant, and is discharged from the discharge port of the compressor 2 (point A in FIG. 2). The high-temperature and high-pressure gas refrigerant, discharged from the compressor 2, flows into the outdoor heat exchanger 3 and rejects heat to the outdoor air, and flows out of the outdoor heat exchanger 3.

The refrigerant flowing out of the outdoor heat exchanger 3 flows into the internal heat exchangers 20*a* and 20*b*, and is cooled by the refrigerant in a low-temperature two-phase gas-liquid state having been decompressed by the expansion devices 4*a* and 4*b* to be. As such, the refrigerant flowing from the outdoor heat exchanger 3 to the internal heat exchangers 20*a* and 20*b* becomes liquid refrigerant and flows out of the internal heat exchangers 20*a* and 20*b* (point C in FIG. 2), and flows into the expansion devices 4*a* and 4*b*.

Here, when the air-conditioning apparatus 100 activates, as the refrigerant is stagnating (is stored in a state of liquid refrigerant) in the outdoor heat exchanger 3 or the like, the amount of refrigerant circulating in the refrigeration cycle 1 is decreased. In such a state, the refrigerant flowing out of the outdoor heat exchanger 3 is likely to be in a gas-liquid two-phase state (point B in FIG. 2). As such, in a conventional multiple-chamber air-conditioning apparatus not having the internal heat exchanger 20, refrigerant in a gas-liquid two-phase state flows into the expansion device. Accordingly, in the conventional multiple-chamber air-conditioning apparatus, there is a problem that the amount of refrigerant flowing through the expansion device is unstable at the time of activation, so that the high pressure and the low pressure of the refrigeration cycle become unstable. Further, in the conventional multiple-chamber air-conditioning apparatus, there is a problem that the amount of refrigerant flowing through the expansion device becomes unstable at the time of activation, so that noise is generated from the expansion device.

However, in the air-conditioning apparatus 100 of the present embodiment, even in the case where refrigerant in a gas-liquid two-phase state flows out of the outdoor heat exchanger 3, the refrigerant is cooled by the internal heat exchangers 20*a* and 20*b* to be liquid refrigerant and flows into the expansion devices 4*a* and 4*b* as liquid refrigerant. Therefore, in the air-conditioning apparatus 100 of the present embodiment, it is possible to prevent the high pressure and the low pressure of the refrigeration cycle to be unstable at the time of activation, and to prevent generation of noise from the expansion devices 4*a* and 4*b*.

The liquid refrigerant flowing into the expansion devices 4*a* and 4*b* is decompressed by the expansion devices 4*a* and 4*b* to be in a low-temperature two-phase gas-liquid state (point D in FIG. 2) and flows out of the expansion devices 4*a* and 4*b*. It should be noted that the decompression amount of the refrigerant in each of the expansion devices 4*a* and 4*b*, that is, the opening degree of each of the expansion devices 4*a* and 4*b*, is controlled by the control unit 51 such that a difference between the condensing temperature and temperature detected by each of the first temperature sensors 32*a* and 32*b* falls within a prescribed temperature range, as described above.

The refrigerant in a low-temperature two-phase gas-liquid state, flowing out of the expansion devices 4*a* and 4*b*, flows into the internal heat exchangers 20*a* and 20*b*. Then, after cooling the refrigerant flowing from the outdoor heat exchanger 3 to the internal heat exchangers 20*a* and 20*b* (point E in FIG. 2), the refrigerant flows into the indoor heat exchangers 5*a* and 5*b*. The refrigerant, flowing into the indoor heat exchangers 5*a* and 5*b*, cools the indoor air, and then flows out of the indoor heat exchangers 5*a* and 5*b* (point F in FIG. 2). The refrigerant flowing out of the indoor heat exchangers 5*a* and 5*b* is sucked from the suction port of the compressor 2, and is compressed to be high-temperature and high-pressure gas refrigerant again by the compressor 2.

(During Stable Operation)

After the transition period immediately after the activation has passed, in the refrigeration cycle 1 of the air-conditioning apparatus 100, the refrigerant stagnating in the outdoor heat exchanger 3 or the like begins to circulate, and the apparatus is in a stable state. The air-conditioning apparatus 100 of the present embodiment can achieve the advantageous effects described below, relative to the conventional multiple-chamber air-conditioning apparatus not having the internal heat exchanger 20 at the time of stable operation.

In a refrigeration cycle having one indoor heat exchanger, as a method of controlling the amount of refrigerant flowing through the indoor heat exchanger to be the amount appropriate to the cooling load in the cooling operation, a method of controlling the opening degree of the expansion device to control a degree of superheat and a method of controlling the opening degree of the expansion device to control a degree of subcooling may be considered. Controlling a degree of superheat means a method of controlling the opening degree of the expansion device such that a degree of superheat (evaporating temperature–refrigerant temperature at the outlet of indoor heat exchanger) of the refrigerant, flowing through the indoor heat exchanger serving as an evaporator, falls within a prescribed temperature range. Controlling a degree of subcooling means a method of controlling the opening degree of the expansion device such that a degree of subcooling (condensing temperature-refrigerant temperature at the outlet of outdoor heat exchanger) of the refrigerant flowing through the outdoor heat exchanger serving as a condenser, that is, a degree of subcooling of the refrigerant flowing into the expansion device, falls within a prescribed temperature range.

However, in the case of a multiple-chamber air-conditioning apparatus, different air conditioning loads are placed on respective indoor heat exchangers. This means that in a multiple-chamber air-conditioning apparatus, as the flow amount of the refrigerant flowing inside multiple-chamber air-conditioning apparatuses differ from one another, it is necessary to control the opening degree of each expansion device provided corresponding to one of the indoor heat exchangers. In that case, in a conventional multiple-chamber air-conditioning apparatus, when attempting to control the opening degree of each expansion device by controlling a degree of subcooling, it is impossible to make the opening degree different for each expansion device. In other words, in a conventional multiple-chamber air-conditioning apparatus, when attempting to control the opening degree of each expansion device by controlling the degree of subcooling, it is impossible to make the flow amount of the refrigerant different for each indoor heat exchanger, because the opening degree of each expansion device is controlled based on a common degree of subcooling. Accordingly, in the conventional multiple-chamber air-conditioning apparatus, the flow amount of the refrigerant of each indoor heat exchanger is controlled by controlling a degree of superheat. However, in the case of controlling the flow amount of the refrigerant of each indoor heat exchanger by controlling the degree of superheat, the refrigerant flowing near the outlet of each indoor heat exchanger becomes gas refrigerant (superheated gas) having a lower heat transfer coefficient compared with the refrigerant in a gas-liquid two-phase state (see points G and H in FIG. 2). Therefore, in the conventional multiple-chamber air-conditioning apparatus, there is a problem that heat transfer performance of each indoor heat exchanger deteriorates in the cooling operation.

On the other hand, in the air-conditioning apparatus 100 of the present embodiment, the internal heat exchangers 20*a* and 20*b* are provided corresponding to the expansion devices 4*a* and 4*b*, respectively. As such, in the air-conditioning apparatus 100 of the present embodiment, the degree of subcooling of the refrigerant flowing to the expansion devices 4*a* and 4*b* can be changed for each of the expansion devices 4*a* and 4*b*. Accordingly, in the air-conditioning apparatus 100 of the present embodiment, it is possible to control the opening degrees of the expansion devices 4*a* and 4*b* independently by controlling the degree of subcooling. In the case of controlling the opening degrees of the expansion devices 4*a* and 4*b* by controlling the degree of subcooling, when the amount of refrigerant with which the refrigeration cycle 1 is filled has been known, it is possible to arbitrarily change the state of the refrigerant flowing near the outlets of the indoor heat exchangers 5*a* and 5*b* serving as evaporators, according to the setting range of the control target range of the degree of subcooling (prescribed temperature range described above). Accordingly, in the air-conditioning apparatus 100 of the present embodiment, it is unnecessary to make the refrigerant flowing near the outlets of the indoor heat exchangers 5*a* and 5*b* become gas refrigerant. In the air-conditioning apparatus 100 of the present embodiment, the refrigerant flowing near the outlets of the indoor heat exchangers 5*a* and 5*b* (point F in FIG. 2) is two-phase gas-liquid refrigerant having quality of a level (for example, quality 0.9 or higher) with which the compressor 2 is not disturbed even if the refrigerant is in a saturated vapor state or liquid back is caused. Therefore, in the air-conditioning apparatus 100 of the present embodiment, the heat transfer performance of the indoor heat exchangers 5 and 5*b* can be improved compared with the conventional one. This means that in the air-conditioning apparatus 100 of the present embodiment, energy saving characteristic is improved compared with that of a conventional multiple-chamber air-conditioning apparatus.

It should be noted that the effect of improving the heat transfer performance is also achievable even at the time of activation.

Further, in a conventional multiple-chamber air-conditioning apparatus, liquid refrigerant flows through a refrigerant pipe from the outlet of the outdoor heat exchanger to the expansion device. This is because when refrigerant in a gas-liquid two-phase state flows into the expansion device as described above, problems such as the high pressure and the low pressure of the refrigeration cycle being unstable and noise being generated from the expansion device are caused. Meanwhile, in the air-conditioning apparatus 100 of the present embodiment, as the internal heat exchanger 20 is provided, it is possible to allow either liquid refrigerant or refrigerant in a gas-liquid two-phase state to flow through the refrigerant pipe from the outlet of the outdoor heat exchanger 3 to the internal heat exchanger 20.

A state of allowing liquid refrigerant to flow through the refrigerant pipe from the outlet of the outdoor heat exchanger 3 to the internal heat exchanger 20 is a state where the point B in FIG. 2 is shifted to the left side (supercooled liquid side) from the saturated liquid line. This means that energy required for cooling the refrigerant flowing from the outdoor heat exchanger 3 to the internal heat exchangers 20*a* and 20*b* (from point D to point E in FIG. 2) is smaller than the case where refrigerant in a two-phase gas-liquid flows through the refrigerant pipe from the outlet of the outdoor heat exchanger 3 to the internal heat exchanger 20. In other words, it is a state where the point E approaches the point D in FIG. 2. As such, in the air-conditioning apparatus 100 of the present embodiment, by allowing liquid refrigerant to flow through the refrigerant pipe from the outlet of the outdoor heat exchanger 3 to the internal heat exchanger 20, the cooling performance of the indoor heat exchangers 5*a* and 5*b* can be improved, compared with the case where refrigerant in a gas-liquid two-phase state flows through the refrigerant pipe from the outlet of the outdoor heat exchanger 3 to the internal heat exchanger 20.

Meanwhile, in the case where refrigerant in a gas-liquid two-phase state flows through the refrigerant pipe from the outlet of the outdoor heat exchanger 3 to the internal heat exchanger 20 in the air-conditioning apparatus 100, the amount of refrigerant with which the refrigeration cycle 1 is filled can be reduced, compared with the case of a conventional multiple-chamber air-conditioning apparatus in which liquid refrigerant flows through the refrigerant pipe from the outlet of the outdoor heat exchanger to the expansion device. R32, HFO1234yf, HFO1234ze, HFO1123, and hydrocarbon are flammable refrigerant. Therefore, in the case of using such refrigerant, it is preferable to prevent a condition that the refrigerant leaks into the room and stagnates so that the volume concentration of the refrigerant in the room reaches the combustible concentration range. In the air-conditioning apparatus 100 of the present embodiment, with a configuration of allowing refrigerant in a gas-liquid two-phase state to flow through the refrigerant pipe from the outlet of the outdoor heat exchanger 3 to the internal heat exchanger 20, the amount of refrigerant in the refrigeration cycle 1 can be reduced. Therefore, it is possible to prevent the volume concentration of the refrigerant in the room from reaching the combustible concentration range more reliably than the conventional one.

Further, in the case of allowing refrigerant in a gas-liquid two-phase state to flow through the refrigerant pipe from the outlet of the outdoor heat exchanger 3 to the internal heat exchanger 20 in the air-conditioning apparatus 100, a difference between the refrigerant amount required in the heating operation and the refrigerant amount required in the cooling operation can be decreased. In detail, in a multiple-chamber air-conditioning apparatus, a compressor, a flow switching device, and an outdoor heat exchanger, of the components of the refrigeration cycle, are accommodated in an indoor unit, generally. Further, an indoor heat exchanger and an expansion device are also accommodated in the indoor unit. Therefore, the outdoor unit and the indoor unit are connected with each other via a refrigerant pipe between the outdoor heat exchanger and the expansion device and via a refrigeration pipe between the indoor heat exchanger and the flow switching device.

A difference between the amount of refrigerant required in the heating operation and the amount of refrigerant required in the cooling operation is caused because the state of the refrigerant flowing through the refrigerant pipe differs in the heating operation from that in the cooling operation. In the heating operation, gas refrigerant flows through the refrigerant pipe between the outdoor heat exchanger and the expansion device and through the refrigerant pipe between the indoor heat exchanger and the flow switching device. In the cooling operation, in the case of a conventional multiple-chamber air-conditioning apparatus, liquid refrigerant flows through the refrigerant pipe between the outdoor heat exchanger and the expansion device, and gas refrigerant flows through the refrigerant pipe between the indoor heat exchanger and the flow switching device. Accordingly, in a conventional multiple-chamber air-conditioning apparatus, there is a large difference between the amount of refrigerant required in the heating operation and the amount of refrigerant required in the cooling operation. As such, to retain refrigerant in the heating operation, it is necessary to provide an accumulator or a receiver to the refrigeration cycle. On the other hand, in the air-conditioning apparatus 100 of the present embodiment, in the cooling operation, it is possible to allow refrigerant in a gas-liquid two-phase state to flow through the refrigerant pipe between the outdoor heat exchanger 3 and the expansion device 4 (in detail, the internal heat exchanger 20), and gas refrigerant or refrigerant in a gas-liquid two-phase state flows through the refrigerant pipe between the indoor heat exchanger 5 and the flow switching device 6. This means that in the air-conditioning apparatus 100 of the present embodiment, a portion of the refrigerant flowing through the refrigerant pipe between the outdoor heat exchanger 3 and the expansion device 4 (in detail, the internal heat exchanger 20) is gas refrigerant. As such, in the air-conditioning apparatus 100 of the present embodiment, a difference between the amount of refrigerant required in the heating operation and the amount of refrigerant required in the cooling operation can be decreased. Accordingly, in the air-conditioning apparatus 100 of the present embodiment, an accumulator or a receiver that is provided in a conventional multiple-chamber air-conditioning apparatus can be removed. Thus, the air-conditioning apparatus 100 can be a compact air-conditioning apparatus compared with the conventional one.

[Heating Operation]

In heating operation, the flow channel in the flow switching device 6 is a flow channel shown by a broken line in FIG. 1. As such, when the compressor 2 activates, the refrigerant in the refrigeration cycle 1 flows in a direction indicated by a broken-line arrow in FIG. 1. Specifically, when the compressor 2 activates, refrigerant is sucked from the suction port of the compressor 2. Then, the refrigerant becomes high-temperature and high-pressure gas refrigerant, and is discharged from the discharge port of the compressor 2. The high-temperature and high-pressure gas refrigerant discharged from the compressor 2 flows into the indoor heat exchangers 5*a* and 5*b* to heat the indoor air, and becomes refrigerant in a gas-liquid two-phase state or in a liquid state and flows out of the indoor heat exchangers 5*a* and 5*b*.

The refrigerant flowing out of the indoor heat exchangers 5*a* and 5*b* flows into the internal heat exchangers 20*a* and 20*b*, and is cooled by the refrigerant decompressed by the expansion devices 4*a* and 4*b* to be in a low-temperature two-phase gas-liquid state. As such, the refrigerant flowing from the indoor heat exchangers 5*a* and 5*b* to the internal heat exchangers 20*a* and 20*b* becomes liquid refrigerant, and flows out of the internal heat exchangers 20*a* and 20*b* into the expansion devices 4*a* and 4*b*.

The liquid refrigerant flowing into the expansion devices 4*a* and 4*b* is decompressed by the expansion devices 4*a* and 4*b* to be in a low-temperature two-phase gas-liquid state, and flows out of the expansion devices 4*a* and 4*b*. It should be noted that the decompression amounts in the expansion devices 4*a* and 4*b*, that is, the opening degrees of the expansion devices 4*a* and 4*b*, are controlled by the control unit 51 such that a difference between the condensing temperature and the temperature detected by each of the second temperature sensors 33*a* and 33*b* falls within a prescribed temperature range.

The refrigerant in a low-temperature two-phase gas-liquid state, flowing out of the expansion devices 4*a* and 4*b*, flows into the internal heat exchangers 20*a* and 20*b*. Then, the refrigerant cools the refrigerant flowing from the indoor heat exchangers 5*a* and 5*b* to the internal heat exchangers 20*a* and 20*b*, and then flows into the outdoor heat exchanger 3. The refrigerant flowing into the outdoor heat exchanger 3 absorbs heat from the outdoor air and evaporates, and then flows out of the outdoor heat exchanger 3. The refrigerant flowing out of the outdoor heat exchanger 3 is sucked from the suction port of the compressor 2, and is compressed to be high-temperature and high-pressure gas refrigerant again, by the compressor 2.

It should be noted that the air-conditioning apparatus 100 is just an example. The air-conditioning apparatus 100 may be configured as illustrated in FIG. 3, for example.

Figure 3:
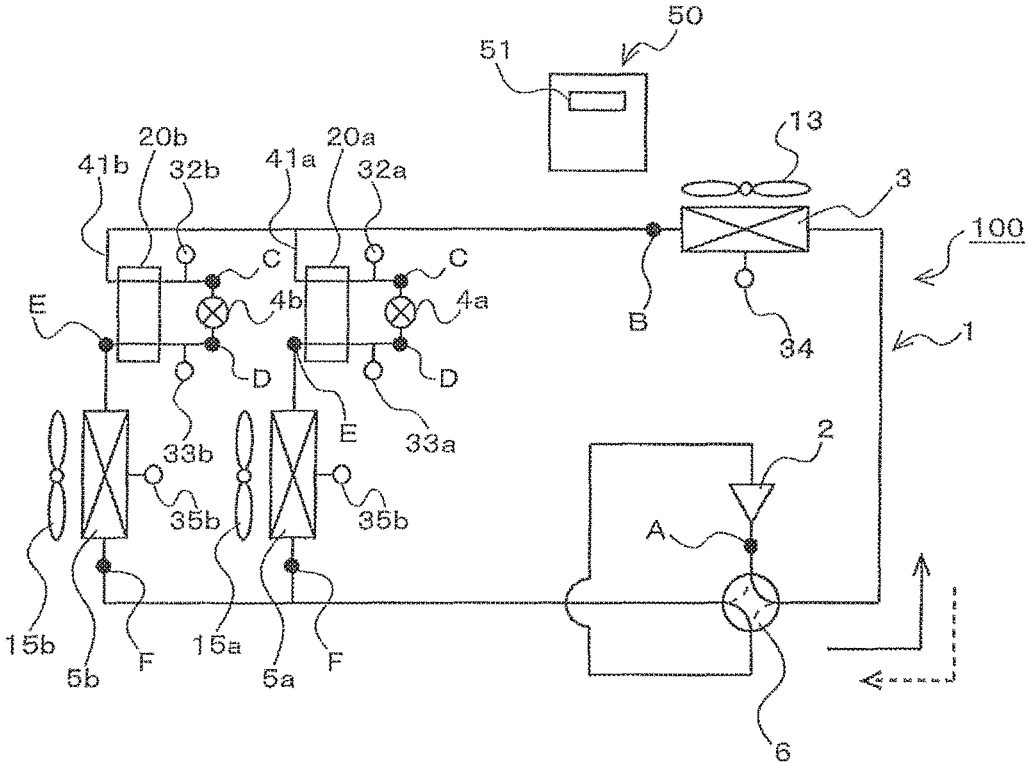
FIG. 3 is a configuration diagram illustrating another embodiment of an air-conditioning apparatus according to an embodiment of the present invention.

FIG. 3 is a configuration diagram illustrating another exemplary embodiment of an air-conditioning apparatus according to the embodiment of the present invention. In the air-conditioning apparatus 100 illustrated in FIG. 1, a detector of the present invention is configured of the pressure sensor 31. In the air-conditioning apparatus 100 illustrated in FIG. 3, a detector is configured of a third temperature sensor 34 and a fourth temperature sensor 35. In detail, the third temperature sensor 34 is provided at a center portion of the outdoor heat exchanger 3, for example, and detects condensing temperature of the refrigerant flowing through the outdoor heat exchanger 3 in the cooling operation. This means that the third temperature sensor 34 serves as a detector in the cooling operation. Further, the fourth temperature sensor 35 is provided at a center portion of the indoor heat exchanger 5, for example, and detects condensing temperature of the refrigerant flowing through the indoor heat exchanger 5 in the heating operation. This means that the fourth temperature sensor 35 serves as a detector in the heating operation. In FIG. 4, two fourth temperature sensors 35*a* and 35*b* are provided corresponding to the indoor heat exchangers 5*a* and 5*b*. It should be noted that as detectors, in addition to the pressure sensor 31, the third temperature sensor 34 and the fourth temperature sensor 35 may be provided, of course.

While the air-conditioning apparatus 100 having two indoor heat exchangers 5 has been described in FIGS. 1 and 3, the air-conditioning apparatus 100 may have three or more indoor heat exchangers 5, of course. Even when the air-conditioning apparatus 100 is configured in such a manner, the advantageous effects described above can be achieved.

Further, while a multiple-chamber air-conditioning apparatus has been described as an example of the air-conditioning apparatus 100 in FIGS. 1 and 3, it is only necessary that the air-conditioning apparatus 100 includes at least one indoor heat exchanger 5. Even in the case of the air-conditioning apparatus 100 having only one indoor heat exchanger 5, the heat transfer performance of the indoor heat exchanger 5 can be improved, compared with the conventional air-conditioning apparatus in which the opening degree of the expansion device is controlled by a degree of superheat. Further, even in the air-conditioning apparatus 100 having only one indoor heat exchanger 5, it is possible to prevent the high-pressure and the low pressure of the refrigeration cycle from being unstable at the time of activation, and to prevent noise from the expansion devices 4*a* and 4*b*. Further, even in the air-conditioning apparatus 100 having only one indoor heat exchanger 5, it is possible to decrease the difference between the amount of refrigerant required in the heating operation and the amount of refrigerant required in the cooling operation, and to remove an accumulator or a receiver.

The invention claimed is:

1. An air-conditioning apparatus comprising:

a refrigeration cycle circuit in which a compressor, a first heat exchanger, an expansion device, and a second heat exchanger are connected sequentially to circulate a refrigerant therethrough;

a third heat exchanger configured to cause the refrigerant flowing through a refrigerant pipe between the first heat exchanger and the expansion device to exchange heat with the refrigerant flowing through a refrigerant pipe between the expansion device and the second heat exchanger;

a detector configured to detect at least one of a temperature and a pressure of the refrigerant flowing through one of the first heat exchanger and the second heat exchanger that serves as a condenser;

a first temperature sensor, being provided on a refrigerant pipe between the expansion device and the third heat exchanger, configured to detect a temperature of the refrigerant flowing from the first heat exchanger to the expansion device and then into the expansion device; and a control unit configured to, at a time of a cooling operation in which the second heat exchanger serves as an evaporator, control an opening degree of the expansion device based on results of detection by the detector and the first temperature sensor, and configured to control the opening degree of the expansion device such that a difference between a condensing temperature and a detection temperature of the first temperature sensor is within a temperature range that is a control target range of a degree of subcooling, the condensing temperature being a condensing temperature of the refrigerant flowing through the condenser, and obtained from a detection value of the detector.

2. The air-conditioning apparatus of claim 1, further comprising:

a plurality of the second heat exchangers, wherein the second heat exchangers are connected in parallel between the first heat exchanger and the compressor, and expansion devices and third heat exchangers are provided corresponding to each of the second heat exchangers.

3. The air-conditioning apparatus of claim 1, wherein in the cooling operation, the refrigerant in a gas-liquid two-phase state flows out of the first heat exchanger, and the refrigerant in the two-phase gas-liquid state is cooled by the third heat exchanger and flows into the expansion device in a liquid state.

4. The air-conditioning apparatus of claim 1, further comprising:

a flow switching device configured to switch to connect a discharge port of the compressor to one of the first heat exchanger and the second heat exchanger, and switch to connect a suction port of the compressor to another one of the first heat exchanger and the second heat exchanger; and a second temperature sensor configured to detect a temperature of the refrigerant at a segment of refrigerant pipe between the expansion device and the third heat exchanger, the segment being part of the refrigerant pipe between the expansion device and the second heat exchanger, wherein the control unit is configured to, at a time of a heating operation in which the second heat exchanger serves as a condenser, control the opening degree of the expansion device based on results of detection by the detector and the second temperature sensor.

5. The air-conditioning apparatus of claim 1, wherein the refrigerant circulating the refrigeration cycle circuit comprises at least one of R32, HFO1234yf, HFO1234ze, HFO1123, and hydrocarbon.

* * * * *